United States Patent [19]

Benninger et al.

[11] 4,024,192

[45] May 17, 1977

[54] PERFLUOROCYCLOHEXYL ETHERS

[75] Inventors: Siegfried Benninger, Schwalbach, Taunus; Thomas Martini, Neuenhain, Taunus, both of Germany

[73] Assignee: Hoechst Aktiengesellschaft, Frankfurt am Main, Germany

[22] Filed: Oct. 8, 1974

[21] Appl. No.: 513,080

[30] Foreign Application Priority Data

Oct. 10, 1973 Germany ..... 2350803

[52] U.S. Cl. ..... 260/611 R; 204/59 F; 252/54; 252/364; 252/77; 252/67

[51] Int. Cl.[2] ..... C07C 43/18

[58] Field of Search ..... 260/611 R

[56] References Cited

UNITED STATES PATENTS

| | | | |
|---|---|---|---|
| 2,567,569 | 9/1951 | McBee et al. | 260/611 R X |
| 3,621,066 | 11/1971 | Anderson | 260/611 R |

OTHER PUBLICATIONS

Clayton et al., J. Chem. Soc. (1965) 7370–7377.

*Primary Examiner*—Bernard Helfin
*Attorney, Agent, or Firm*—Curtis, Morris & Safford

[57] ABSTRACT

New and useful perfluorinated cyclohexyl ethers are manufactured by reacting a phenol with hexafluoro propene or tetrafluoro ethylene, dissolving the partly fluorinated phenyl alkyl ethers obtained in hydrofluoric acid and electrolyzing the solution.

5 Claims, No Drawings

PERFLUOROCYCLOHEXYL ETHERS

Perfluorocyclohexylalkyl ethers are a novel class of compounds, which could not be prepared hitherto economically with the known methods.

The fluorination of aromatic hydrocarbons with elementary fluorine and $CoF_3$ or similarly acting metallic fluorides of higher valency leads to the corresponding perfluorinated hydroaromatics in the case of unsubstituted and low-substituted alkyl aromatics, [e.g. such as benzene, anthracene, methyl naphthalene of ethyl benzene], which process is industrially realisable. The same process, however, is unsuitable for fluorinating aromatic alkyl ethers, owing to the fact that a substantial cleavage takes place at the oxygen linkage especially in the case of multifunctional phenol ethers.

The electrofluorination of arylakyl ethers according to Simons is no suitable method for preparing perfluorocyclohexylalkyl ethers, either, as tests have shown, because a rapidly progressing decomposition of the compounds and the formation of polymer, tarry material can be observed, causing the breakdown of the process owing to an anode blocking.

The electrofluorination of the corresponding cyclohexylalkyl ethers is no industrially interesting method as well, because only very low current densities can be produced owing to the low solubility of the corresponding cyclohexylalkyl ethers and only small yields are obtained, especially in the case of the multifunctional ethers, because of the easy cleavage of the ether compounds. The aforesaid synthesis is consequently limited to the most primitive representitives of the class having at most 2 ether groups.

The first perfluorocyclohexylethers have been obtained by electrofluorination of pentafluorophenyl and 4-trifluoromethyltetrafluorophenyl-tetrahydrofurfuryl ethers in high yield (see Russian Patent Specification No. 206,565). This process was a great progress as to the yield of the product, but had the great inconvenience that expensive hexafluorobenzene derivatives had to be used, which could only be obtained in a complicated process, whereby the variability of the starting material was considerably limited and the rentability of the process was considerably reduced.

A process has now been found for preparing perfluorinated cyclohexylalkyl ethers of formula I

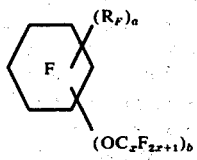

(I)

wherein $R_F$ is a linear or branched perfluoroalkyl radical having from 1 to 10 carbon atoms, $a$ is 0, 1 or 2, $b$ is 1, 2, 3, 4, 5, or 6 and $a+b \leq 6$ and $x$ is 2 or 3, which comprises a) dissolving a mono- or multivalent phenol of the formula

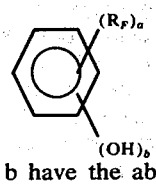

wherein $R_F$, a and b have the above meaning, in an aprotic, polar solvent and reacting it with hexafluoropropylene or tetrafluoroethylene yielding compounds of formula II

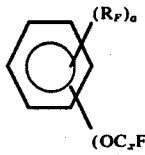

(II)

wherein $R_F$, $x$, $a$ and $b$ have the above meaning and b) dissolving the compounds of formula II in a water-free hydrofluoric acid and electrolizing the solutions at a temperature of from −10° to +30° C and a voltage of from 4 to 7.5 volts. The aromatic ring is thus saturated by fluorine atoms.

The process according to the invention leads to extremely high yields, whereby it is characteristic that the total yields are increased to a great extent depending on the increasing degree of substitution, i.e., increasing values for $a+b$, while the contrary could be observed in all comparable fluorination processes hitherto known.

Especially highly substituted aromatic $HC_xF_{2x}$ ethers are preferably used for carrying out the process according to the invention, the use of aromatic starting compounds compared with the corresponding hydroaromatic starting compounds signifying a saving of current of from 25 to 66%, depending on the degree of substitution, i.e., the value for $a+b$. The higher the starting aromatics are substituted by $R_F$ or $OC_xF_{2x+1}$, the higher the yields in the electrofluorination are.

Electrofluorination process usually yield no uniform products, especially in the case of greater molecules, but perfluorinated substances mixtures, containing besides the desired substances also isomerization, dimerization and decomposition products, and compounds of higher molecular weight. This must be notoriously contributed to the effect of the energetic conditions in the exchange of C-H against C-F.

The process described has the advantage that products of a surprisingly high uniformity are obtained in any case, which cannot be obtained by using starting materials free from fluorine.

Another advantage is that dimerization products and further by-products formed by the addition of fragments to the carbon skeleton of the starting material, which is thus increased, are completely absent.

Also the process according to the invention does not have a further inconvenience of the Simons' process known in literature, the formation of polymer waste products, resulting in a resinification of the anode surface and thus acting as a barrier layer. Notable residues and a current drop owing to anodic coatings could not be observed analytically even after operation times of several hundred hours, which is an essential condition required for an undisturbed continuous process.

The addition of tetrafluoroethylene or hexafluoropropylene to derivatives of phenol is already known. The addition of tetrafluoroethylene is generally effected in the presence of alkali hydroxide at temperatures of from 50° and 150° C (see German Offenlegungsschrift No. 2,029,556).

It has now been found that the reaction of hexafluoropropylene with phenols of the formula

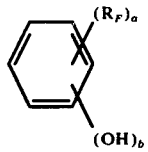

wherein $R_F$, a and b have the above meaning may be effected in an especially simple manner in the presence of trialkylamines. Suitable amines are, for example, triethylamine, tri-n-butylamine, N-methylpiperidine, N,N,N',N'-tetramethyl-ethylenediamine, diazabicyclo-2,2,2-octane.

In comparison with the methods known hitherto, the addition of hexafluoropropylene is effected substantially more rapidly, thus permitting operating without pressure or increased temperature. At least 0.1, preferably 0.25 to 1 mole, of trialkylamine are added per equivalent of the hydroxyl group to be reacted. Still greater quantities of trialkylamines e.g. 10 moles amine per hydroxyl equivalent, may be used, but offer no further advantages.

The invention not only comprises the process described, but also the novel thus accessible cyclic perfluoralkyl ethers which are distinguished by valuable industrial application properties. The physical characteristic data of the products according to the invention (III), especially the boiling points and the viscosity values vary within a wide range. Substances of boiling points of from 100° C to more than 250° C having solidification points substantially lower than the perfluorohydroaromatic compounds hitherto known, may be prepared.

Examples of compounds to be prepared by the process according to the invention are:

a. compounds of the formula III

1.) a = 0

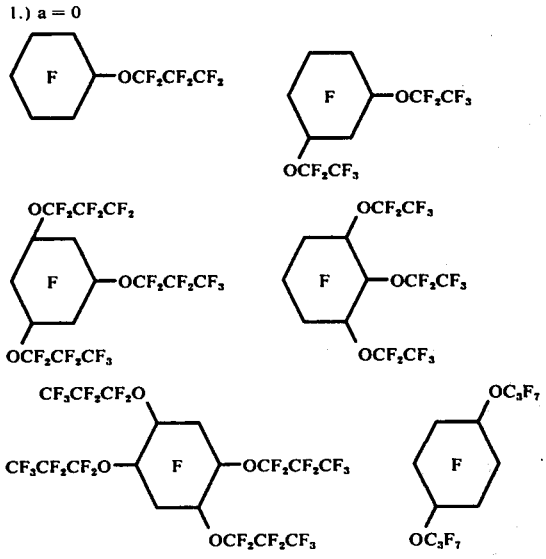

2.) a = 1,2

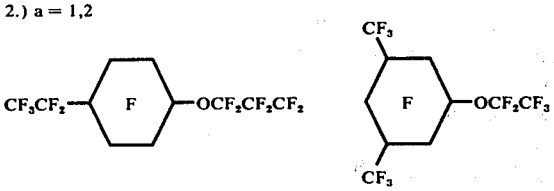

-continued

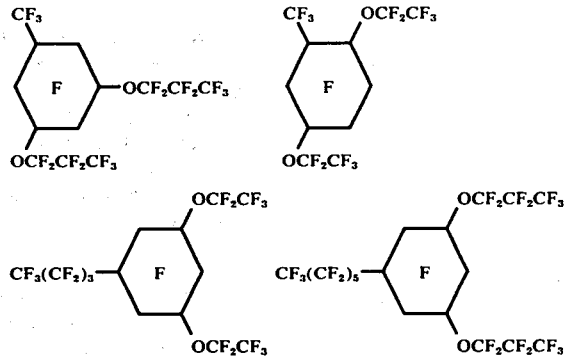

Preferred compounds of formula III are those having no $R_F$ group($a = o$) or those substituted by more than 2 perfluoroalkyl ether groups ($b \geqslant 3$).

The substances III according to the invention are chemically stable against aggressive chemicals, such as concentrated acids, oxidants, oxygen, fluorine, halogen fluorides or metallic fluorides. They are only decomposed at elevated temperatures by alkali metals and concentrated aqueous alkali metal lyes. Their dissolving power for the usual solvents, for example water etc. is extremely low, as well as their swelling ability with regard to plastics materials.

The aforesaid properties open various application possibilities for the substances of the invention, for example, as reaction media, sealing liquids and reaction media for chemical reactions with fluorine or other highly reactive substances, as bearing materials or lubricants under severe chemical conditions, moreover as turbine propellants or hydraulic fluids, whereby the physical conditions may be adapted within wide limits to the requirements by selecting the convenient parameters n, a, b and x.

The substances of the invention may further be used as heat transfer media or as cooling fluids; owing to the broad boiling range covered by the compounds of formula III, low boiling evaporation and difficultly volatile convection cooling fluids can be prepared, which are both required in electrotechnics and electronics.

The electrofluorination of the partly fluorinated substances II is effected in a Simons' cell of known design. It is composed of a brine cooled double-jacketed vessel of stainless steel, having a capacity of about 1.2 liters, which is provided with a set of parallel nickel sheets having a gap width of 3 mm and a total anode surface of 26.1 $dm^2$. The cell further comprises a rapidly conveying electrolyte pump, as well as a reflux condenser for condensing the hydrofluoric acid carried along with the produced hydrogen current. The electrolyses were effected for several days each time at voltages of from 4.0 to 7.5 volts and at current densities of from 0.5 to 3.0, preferably from 1.0 to 2.5($A/dm^2$) at electrolytic temperatures of from −10° to +30° C, preferably from 0° to +15° C. The starting materials are used in the form of 3 to 20% by weight solutions in hydrofluoric acid. The upper concentrations are limited by the solubility in hydrofluoric acid, but are preferably maintained in a range of more than 10% by weight. The perfluorinated products precipitate from the homogeneous solutions in the form of insoluble oils, which are drawn off each time prior to re-adding new starting material.

The electrolytic solutions are constantly electrolyzed to a high degree, i.e., they are as completely converted as possible, whereby the conductibility and, consequently, the current density are reduced towards the end of the process. Because of the reduced depolarizer concentrations the voltage is then limited to about 5.5 volts in order to avoid the formation of $F_2$. The residue is then determined by distilling off the hydrofluoric acid. It mainly consists of the starting material and is found to be each time less than 2%.

The fluorination products are thoroughly washed with hot aqueous alkali metal lye, and dried prior to fractionating. The product analysis is effected by way of gaschromatography. Silicone rubber SE 30 on Chromosorb W-AM-DMCS is used as the stationary phase. For identifying the main components, these are isolated by a preparative column and analyzed by means of their mass spectrum and nuclear-magnetic-resonance spectrum.

EXAMPLE 1

I. PREPARATION OF HYDROQUINONE-BIS-(2-H-HEXAFLUOROPROPYL ETHER)

155 g of hydroquinone were dissolved in 600 ml of dimethyl formamide, whereto 300 ml of triethylamine were added. Hexafluoropropene was then introduced until absorption took place no longer. The reaction temperature was not allowed to surpass 40° C. The mixture was then treated by firstly drawing off dimethyl formamide and triethylamine at the rotation evaporator. The residue was then washed with 400 ml of 1N HCL and 500 ml of dimethyl formamide subsequently, dried and distilled.

Yield: 400 g (66.2% of the theory).

Boiling point: from 54° to 56° C/0.1 torr

According to the infra-red spectrum the product was free from hydroxyl groups, but contained partly insignificant admixtures of olefinic portions of the structure $ROCF{=}CF\text{-}CF_3$ caused by the splitting off of HF under the action of the trialkylamine. The presence of such olefines did not substantially affect the course and the result of the electrofluorination.

Molecular weight: calculated 450

(osometrically in benzene) found 413

II. ELECTROFLUORINATION 100 g of 1,4-bis-(hexafluoropropoxy) benzene and 1,300 g of hydrofluoric acid were introduced into a Simons' cell and electrolyzed for 74 hours at a temperature of +5° C and voltages of from 5.4 to 6.4 volts. 114 g of the product were then added in small portions in several hours' intervals. The quantity of perfluorinated product obtained was 65.6 g, corresponding to 19% of the theory, calculated on the reaction equation.

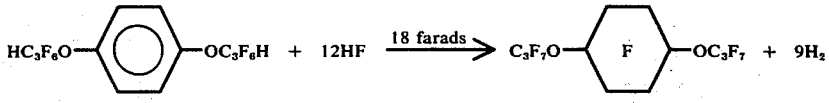

The boiling range of the product was from 142° to 171° C after having washed it with a hot aqueous 10% of KOH solution. The gaschromatogram of the product showed a principal component corresponding to 54 area % and having a highest mass peak of $(m/e) = 613$, corresponding to M minus F.

The structure indicated in the reaction equation, which is in harmony with the mass spectrum could also be supported by the nuclear-magnetic-resonance spectrum.

Analysis:

calculated: 22.4% of C; 72.2% of F; < 0.3% of H found: 22.8% of C; 72.2% of F; 0% of H The component of $C_3F_7OC_2F_4CF_2CF(C_2F_5)OC_3F_7$ having a proportion of 32 area % could also be detected.

EXAMPLE 2

I. PREPARATION OF PYROGALLOL-TRIS(2-H-HEXAFLUOROPROPYL ETHER)

300 ml of triethylamine were added to 63 g of pyrogallol which have been dissolved in 500 ml of dimethylformamide. The temperature rose to 50° C, hexafluoropropene was introduced. The disappearance of the hydroxyl band in the infrared spectrum indicated the end of the reaction. The mixture was poured into 2 liters of water and the two phases were separated. The organic phase was washed again with water and dried.

Yield of the crude product: 280 g (97.3% of the theory)

Yield on distillation: 200 g (69.4% of the theory)

Boiling point: from 73° to 83° C/0.4 torr

According to the infra-red spectrum the product was free from hydroxyl bands, but partly contained insignificant admixtures of olefinic portions of the structure $ROCF = CF\text{-}Cf_3$, caused by the splitting off of HF under the action of the trialkylamine. The presence of such olefins did not substantially affect the course and the result of the electrofluorination.

II. ELECTROFLUORINATION 256 g of fluorination product, corresponding to 56.5% of the theory, calculated on the reaction equation, were obtained from 335 g of pyrogallol-tris-(hexafluoropropyl ether) in the course of 32 hours.

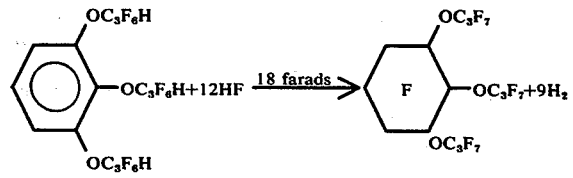

The electrolysis temperature was +5° C, the voltage was maintained in the range of from 5.2 to 6.3 volts but towards the end in the range of less than 5.8 volts. The average current density was 0.53 A/dm². The crude product purified in usual manner distilled at a temperature in the range of from 150° and 218° C, the main quantity of about 49% by weight at a temperature of from 196° to 218° C.

The principal fraction consisted of 3 components having nearly identical mass spectra; the highest mass peak was each time at about $(m/e) = 798$. Nuclear-magnetic-resonance spectra proved the ring structure expected for the principal component (38% of the surface in the unfractionated product)

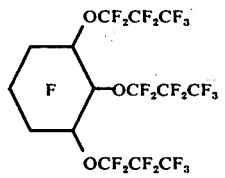

while two secondary components of the infractionated product each having 21 area % were formed by ring separation.

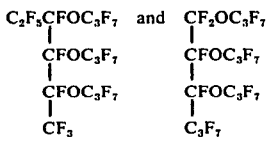

Analysis of the cyclic principal component:
found: 22.0% C; 70.8F; < 0.3% of H
calculated: 22.5% C; 71.3% F; 0% H

EXAMPLE 3

I. PREPARATION OF PHLOROGLUCINOL-TRIS-(2-H-HEXAFLUORO-PROPYL ETHER)

126 g of phloroglucinol were dissolved in one liter of dimethylformamide and mixed with 500 ml of triethylamine. Hexafluoropropene was introduced until the OH band disappeared in the infra-red spectrum. The reaction temperature was maintained at a temperature lower than 50° C. The crude product obtained was heated as in Example 2.
Yield of the crude product: 460 g (79.8% of the theory)
Yield after distillation: 358 g (62.0% of the theory)
Boiling point: from 82° to 88° C/0.2 torr

| Analysis: | C | H | F |
|---|---|---|---|
| calculated: | 31.2 | 1.04 | 59.4 |
| found: | 31.5 | 0.9 | 57.7 |

II. ELECTROFLUORINATION

The cell was filled with 1,300 g of water-free hydrofluoric acid and 100 g of phloroglucinol-tris-(hexafluoropropyl ether). 303 g of starting material were added in portions of 10 to 20 g in the course of the operation time of 79 hours. The fluorination product formed was drawn off prior to each addition. The average electrolysis temperature was +5° C and the voltage being 4.2 volts at the beginning was maintained in the range of less than 6.5 volts. 361 g of fluorination product, corresponding to 64.7% of the theory, calculated on the reaction equation, were obtained.

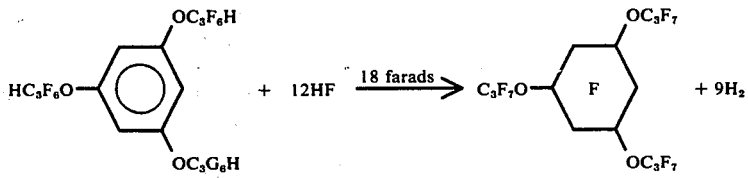

The boiling range of the formed product was of from 120° C to 215° C/756 torrs after purification with alkali. The unfractionated product contained two principal components covering 63 and 17 area % respectively and having substantially identical mass spectra. The highest mass peaks were at ($m/e$) = 799 and 798. The isolation of the components was effected by means of preparative gaschromatography. The ring structure of the principal component indicated in the reaction equation and the following linear structure for the secondary components could be detected by the nuclear-magnetic-resonance spectra:

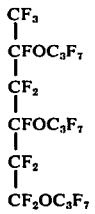

The analysis of the principal component was as follows:
found: 22.4% C; 71.1% F; < 0.3% H
calculated: 22.5% C; 71.3% F; 0% H

EXAMPLE 4

I. PREPARATION OF 1,3-BISTRIFLUOROMETHYL-5-(TETRAFLUORO-ω-H-ETHOXY)-BENZENE

The aforesaid substance was prepared by dissolving 418 g of 3,5-bis(trifluoromethyl) phenol with 55 g of KOH in 600 g of dimethyl formamide. Tetrafluoroethylene was introduced at about 80° C until no further absorption took place. The reaction mixture was treated in an aqueous medium as in Example 2, dried with $Na_2SO_4$ and distilled at a temperature in the range of from 41° to 50° C/0.1 torr. Yield of the purified product: 300 g, corresponding to 51.6% of the theory.

| Analysis: | C | H | F |
|---|---|---|---|
| found: | 37.1 | 0.9 | 55.9 |
| calculated: | 36.4 | 1.1 | 57.6 |

II. ELECTROFLUORINATION

According to the method of Examples 1 to 3, 300 g of 1,3-bis-trifluoromethyl-5-(tetrafluoroethoxy)-benzene were reacted within 48 hours giving 231 g of fluorination product 72% of which consisted of the perfluoro compound of the following structure:

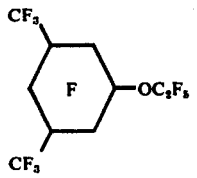

as the nuclear-magnetic-resonance spectrum showed.

The principal fraction of the purified fluorination product had a boiling range of from 124° to 142° C.

Analysis of the cited principal products:

found: 23.7% C; 72.9% F; 0.3% H calculated: 23.2% C; 73.6% F; 0% H

What is claimed is:

1. A compound having the formula

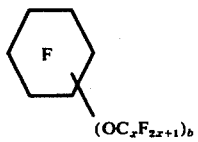

wherein *b* is 3, 4, 5 or 6 and *x* is 2 or 3.

2. A compound having the formula

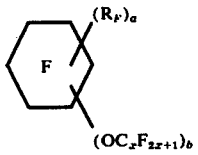

wherein $R_F$ represents a straight chain or branched perfluoroalkyl radical of from 1 to 10 carbon atoms;

*a* is 1 or 2,

*b* is 3, 4 or 5 and a + b ≤ 6 and

*x* is 2 or 3.

3. A compound having the formula

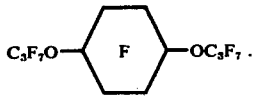

4. A compound having the formula

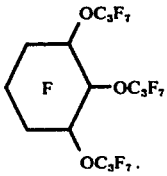

5. A compound having the formula

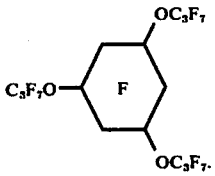

* * * * *